US006612814B2

(12) United States Patent
Shih et al.

(10) Patent No.: US 6,612,814 B2
(45) Date of Patent: Sep. 2, 2003

(54) ELECTRICAL FAN HAVING AN OIL RETAINING RING TO PREVENT LOSS AND EVAPORATION OF LUBRICANT OIL

(75) Inventors: Po-Jen Shih, Taoyuan Hsien (TW); Tai-Ying Lu, Taoyuan Hsien (TW)

(73) Assignee: Ideal Elethermal Inc., Taoyuan Hsien (TW)

( * ) Notice: Subject to any disclaimer, the term of this patent is extended or adjusted under 35 U.S.C. 154(b) by 40 days.

(21) Appl. No.: 10/057,934

(22) Filed: Jan. 29, 2002

(65) Prior Publication Data

US 2003/0143086 A1 Jul. 31, 2003

(51) Int. Cl.[7] ..... F04B 17/00

(52) U.S. Cl. ..... 417/354; 417/423.12; 417/423.13; 417/423.14; 417/423.15

(58) Field of Search ..... 417/423.12, 423.13, 417/423.14, 423.15, 354

(56) References Cited

U.S. PATENT DOCUMENTS 4,620,139 A * 10/1986 Egami et al. ..... 310/62
4,861,237 A * 8/1989 Shiraki et al. ..... 310/68 R
4,987,331 A * 1/1991 Horng ..... 310/152
5,099,181 A * 3/1992 Canon ..... 310/62
5,288,216 A * 2/1994 Bolte ..... 310/62
5,492,458 A * 2/1996 Horng ..... 310/254
5,947,704 A * 9/1999 Hsieh ..... 417/423.12
5,997,265 A * 12/1999 Chung ..... 417/423.13
5,997,267 A * 12/1999 Lee ..... 417/423.14
6,000,919 A * 12/1999 Hsieh ..... 415/220
6,102,675 A * 8/2000 Hsieh ..... 184/100
6,183,221 B1 * 2/2001 Hsieh ..... 415/171.1
6,246,140 B1 * 6/2001 Horng ..... 310/40 MM
6,267,567 B1 * 7/2001 Hsieh ..... 417/354
6,270,325 B1 * 8/2001 Hsieh ..... 417/423.12
6,309,191 B1 * 10/2001 Hu ..... 417/423.12
6,318,976 B1 * 11/2001 Hsieh ..... 310/90
6,368,081 B1 * 4/2002 Matsumoto ..... 417/423.1
6,379,126 B1 * 4/2002 Konno ..... 417/354
6,379,129 B1 * 4/2002 Obara ..... 384/512
6,394,768 B1 * 5/2002 Fukuda et al. ..... 310/71
6,400,053 B1 * 6/2002 Horng ..... 310/67 R
6,416,300 B1 * 7/2002 Tang et al. ..... 417/423.12
6,447,272 B2 * 9/2002 Tsuchiya ..... 310/42
6,457,953 B1 * 10/2002 Bradbury et al. ..... 417/423.1

* cited by examiner

*Primary Examiner*—Charles G. Freay
*Assistant Examiner*—William H. Rodriguez
(74) *Attorney, Agent, or Firm*—Rosenberg, Klein & Lee

(57) ABSTRACT

An electrical fan comprising a blade module and a coil module. The blade module includes a space defined therein, and a shaft. The space has a bottom where an end portion of the shaft is embedded. The coil module includes an oil-retaining bearing, an oil-retaining ring, and a shaft sleeve. The shaft sleeve has an internal flange at a top thereof. The oil-retaining bearing is mounted inside the shaft sleeve, and the oil-retaining ring is clamped between the internal flange and the oil-retaining bearing once the shaft of the blade module has penetrated through the shaft sleeve and the oil-retaining ring of the coil module. Via the oil-retaining ring, the lubricant oil is retained in the oil-retaining bearing, thereby preventing loss and evaporation of lubricant oil.

6 Claims, 4 Drawing Sheets

ELECTRICAL FAN HAVING AN OIL RETAINING RING TO PREVENT LOSS AND EVAPORATION OF LUBRICANT OIL

BACKGROUND OF THE INVENTION

1. Field of the Invention

The invention relates to an electrical fan. More particularly, the invention relates to an electrical fan in which lubricant oil loss is prevented. Thereby, evaporation of the oil retained in the fan can be greatly reduced, and the longevity of the fan can be substantially increased.

2. Description of the Related Art

One type of conventional fans is shown in FIG. 1 and FIG. 2. In FIG. 1 and FIG. 2, the conventional fan mainly consists of a blade module 1, a coil module 2, a circuit board 3, and a base substrate 4. A space 11 is usually defined in the blade module 1 for accommodating the coil module 2. A shaft 12 is mounted at a center of the space 11, and further penetrates through the coil module 2 being placed into the space 11. The shaft 12 and the blade module 1 are together driven in rotation by means of the polarization change of the coil module 2. The coil module 2 has a case 21 which size matches the space 11. A magnet 22, a frame 23 around which coils 24 are wound, a copper-made shaft sleeve 25, an oil-retaining bearing 26, and a buckle 27 are assembled with one another into the case 21. The frame 23 and the coils 24 are mounted inside the magnet 22. The shaft sleeve 25 is mounted inside the frame 23. The oil-retaining bearing 26 is mounted inside the shaft sleeve 25. The buckle 27 which have, for example, a C-shape, abuts against a bottom of the oil-retaining bearing 26 to enable the oil-retaining bearing 26 to engage with a groove 121 defined at a lower end portion of the shaft 12. The shaft sleeve 25 is attached to the circuit board 3 and the base substrate 4.

The oil-retaining bearing 26 contains oil for lubricating the shaft 12 and the coil module 2 when the fan rotates, especially at high speed. Rotating the fan at high speed generates a lot of heat, and allows the oil contained in the oil-retaining bearing 26 to flow upward. The oil-retaining bearing 26 has an opened top through which the lubricant oil flows from the oil-retaining bearing 26 and evaporates. Once the lubricant oil is completely consumed, the rotating fan is no longer provided with lubricant oil. A substantial amount of heat is thus increasingly generated by friction, resulting in noise or malfunction.

Another type of conventional fans is illustrated in FIG. 3. In FIG. 3, the lubricant oil of the oil-retaining bearing 26 evaporates at reduced speed by means of plastic gaskets 281, 282 mounted on a top and a bottom of the oil-retaining bearing 26, respectively. The plastic gasket 281 absorbs most of the upward oil flowing. The plastic gasket 282 absorbs the remaining lubricant oil flowing downward once the fan has stopped. Thereby, the lubricant oil of the oil-retaining bearing 26 is prevented from leaking out. The main function of the oil-retaining bearing 26 is to contain the lubricant oil flowing through the bearing to provide lubrication. However, the plastic gasket 281 progressively absorbs the lubricant oil flowing upward and the plastic gasket 282 progressively absorbs that flowing downward. The lubricant oil in the oil-retaining bearing 26 is thus increasingly reduced. Moreover, the lubricant oil absorbed by the plastic gaskets 281, 282 may evaporate through an externally exposed area of the plastic gaskets 281, 282.

Therefore, an improved fan that has a longer longevity without lubricant oil loss is needed.

SUMMARY OF THE INVENTION

It is therefore a principal object of the invention to provide an improved fan in which a stopper ring is mounted around a top of an oil-retaining bearing to buckle the oil-bearing bearing and stop a lubricant oil from leaking out. Thereby, evaporation or leakage of the oil retained in the fan can be favorably reduced, and the longevity of the fan can be substantially increased.

It is another object of the invention to provide an improved fan, in which a bottom of the shaft sleeve is provided with a wear resistant sheet, and optionally further provided with a magnet, and a magnetically susceptible sheet in order to prevent the oil contained in the oil-retaining bearing from leaking out.

In accordance with the above and other objectives, the invention provides an improved fan that comprises a blade module and a coil module. The blade module includes a shaft and a recess. The recess defined in the blade module has a bottom where an end portion of the shaft is embedded. The coil module includes an oil-retaining bearing, an oil stopper ring and a shaft sleeve. The shaft sleeve has an internal flange at a top thereof. The oil-retaining bearing is mounted inside the shaft sleeve, and the oil-retaining ring is clamped between the internal flange and the oil-retaining bearing after the shaft of the blade module penetrates through the shaft sleeve and the oil-retaining ring. Via the oil stopper ring, the oil is retained in the oil-retaining bearing without substantial loss and evaporation. Thereby, the longevity of the fan of the invention is greatly increased.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
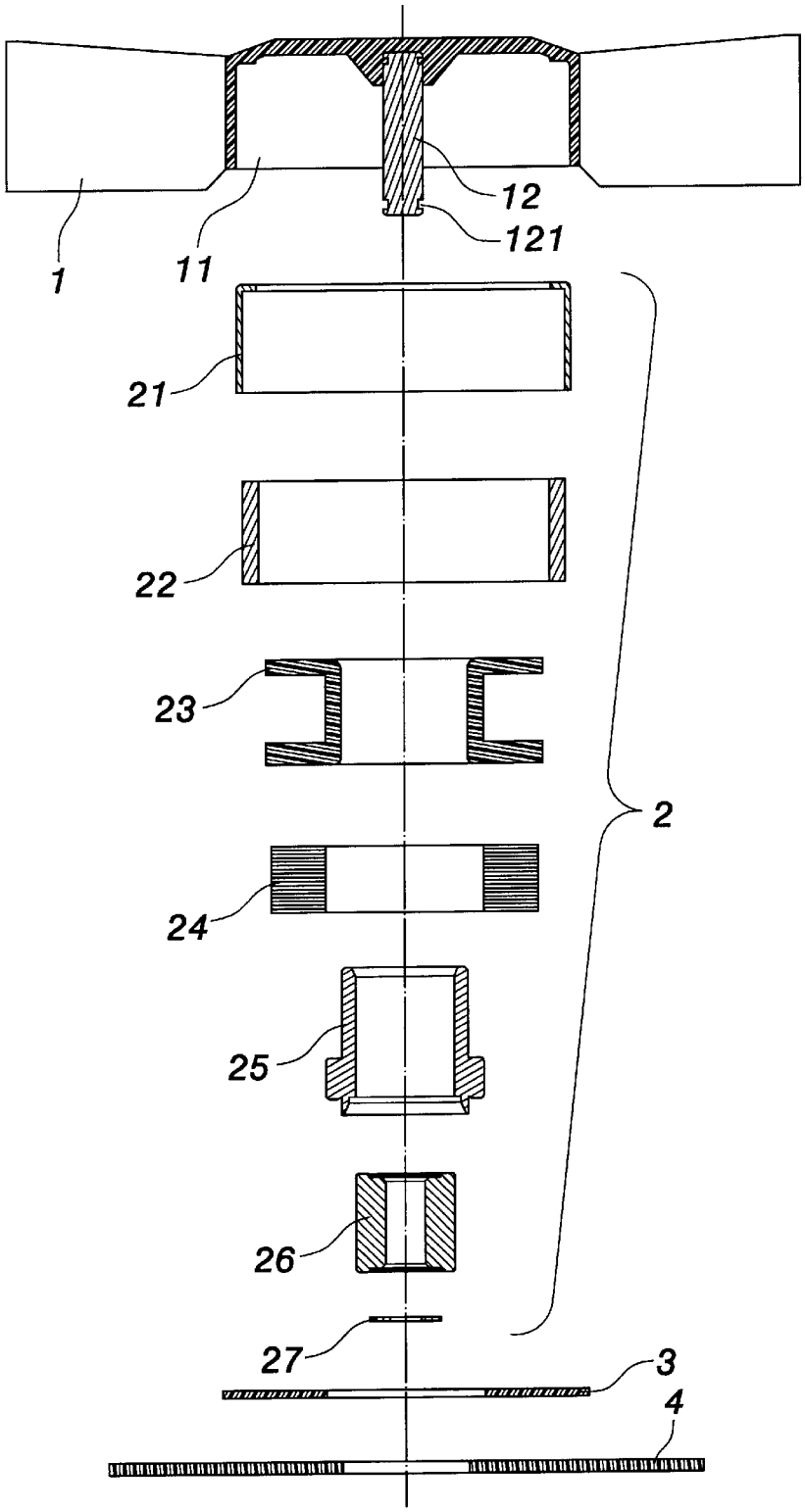
FIG. 1 PRIOR ART
FIG. 1 is an exploded view of a first conventional fan.
Figure 2:
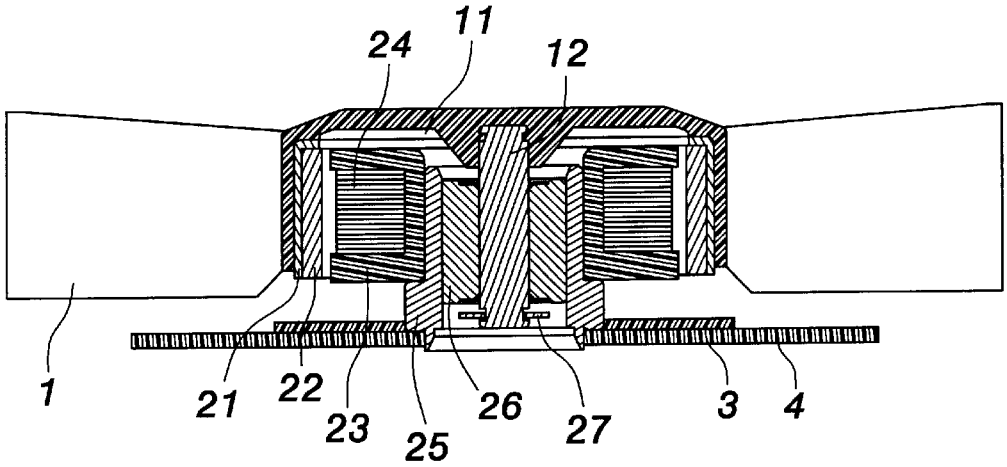
FIG. 2 PRIOR ART
FIG. 2 is a cross-sectional view of FIG. 1 after assembly.
Figure 3:
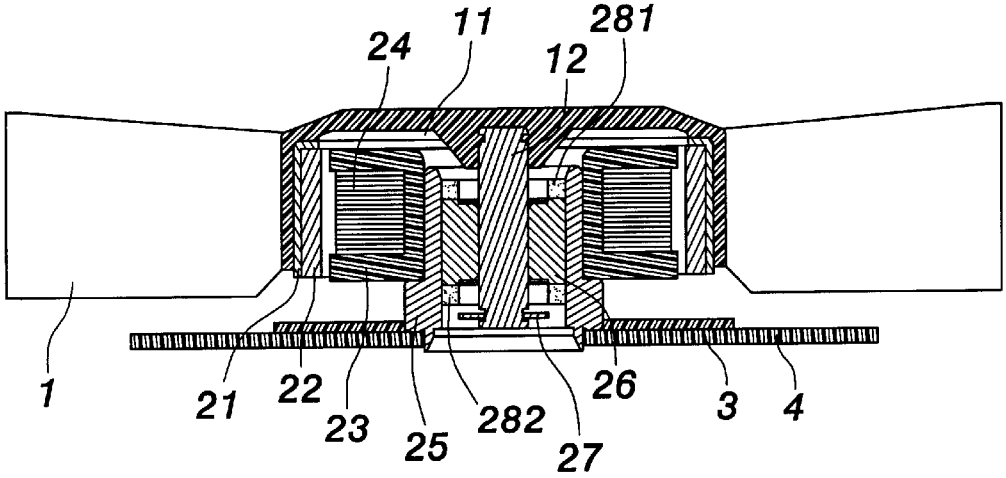
FIG. 3 PRIOR ART
FIG. 3 is a cross-sectional view of a second conventional fan.

Wherever possible in the following description, like reference numerals will refer to like elements and parts unless otherwise illustrated.

Figure 4:
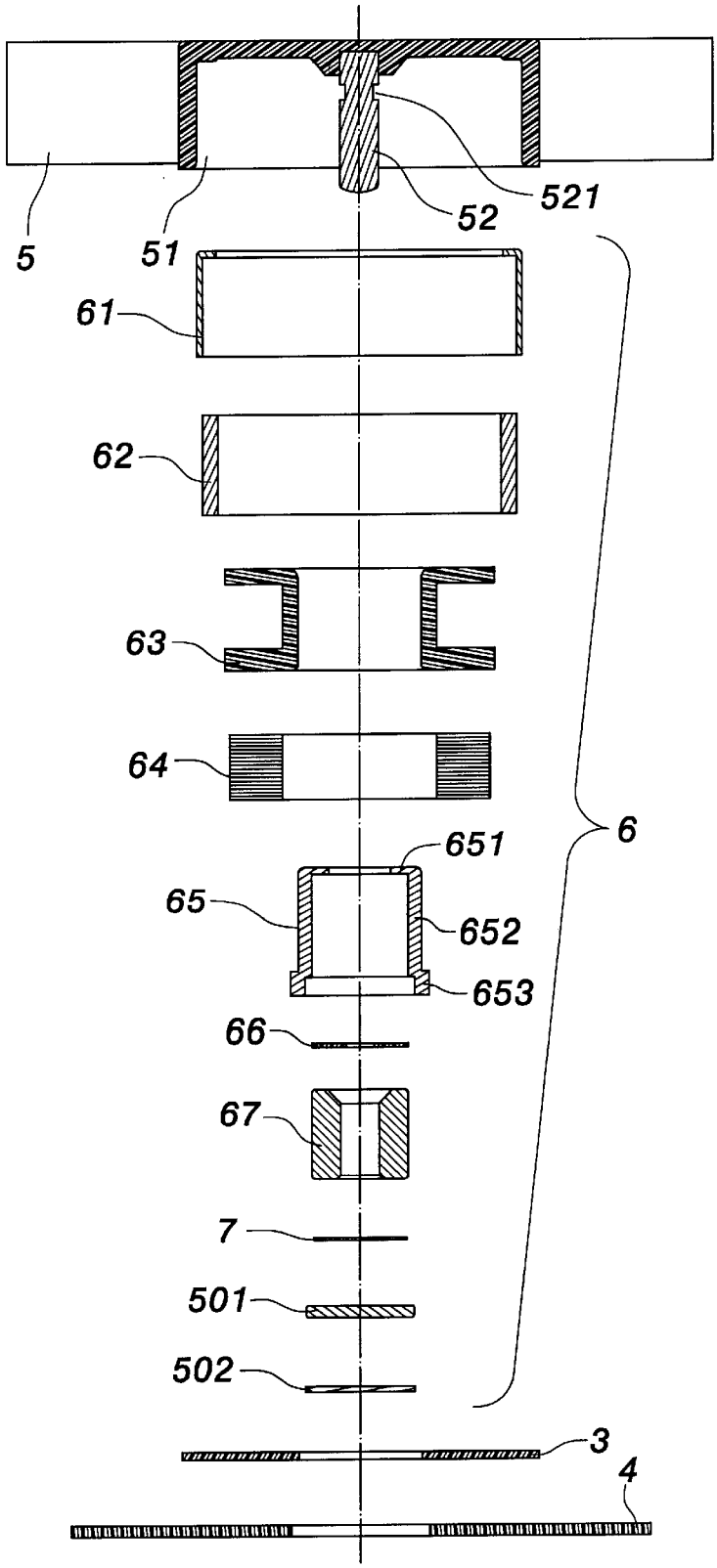
FIG. 4 is an exploded view of a fan according to an embodiment of the invention.
Figure 5:
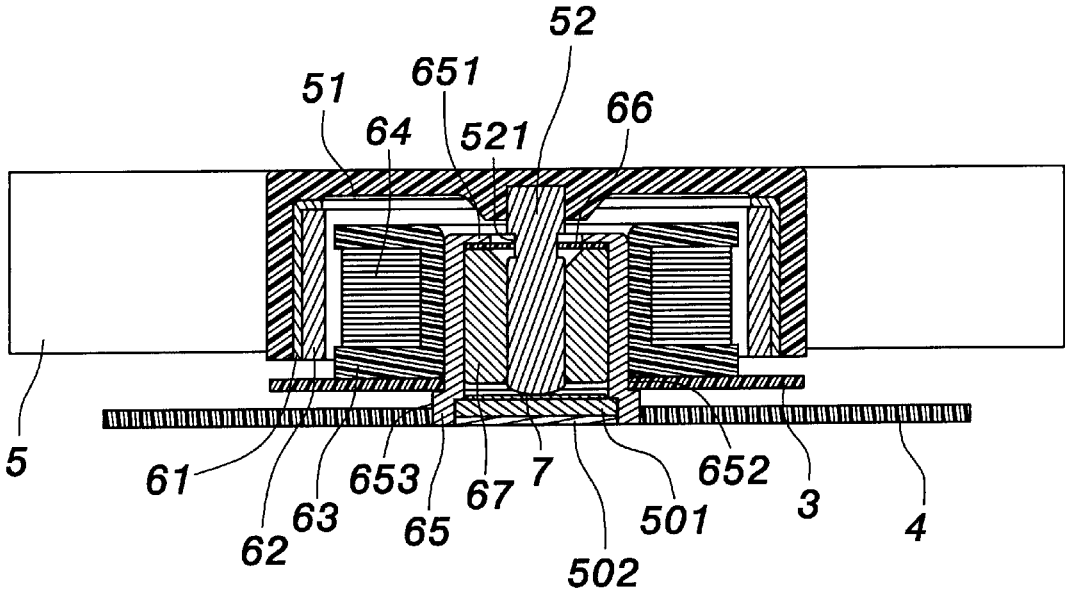
FIG. 5 is a cross-sectional view of FIG. 4 after assembly.

FIG. 4 and FIG. 5 show cross-sectional views of a fan according to an embodiment of the invention. The fan includes a blade module 5 and a coil module 6. The coil module 6 includes a shaft sleeve 65 having a bottom attached to a circuit board 3 and a base substrate 4.

A space 51 is defined through the blade module 5 to receive a shaft 52 at a central portion thereof. The space 51 has a bottom where an end portion of the shaft 52 is embedded. The coil module 6 includes a metallic case 61, a magnet 62, a frame 63 around which coils 64 are wound, the shaft sleeve 65, and an oil-retaining bearing 67. The metallic case 61 is mounted inside the space 51. The magnet 62 is placed inside the metallic case 61. The frame 63 is mounted inside the magnet 62 and generates a polarization change from positive to negative and reciprocally. The shaft sleeve 65 is mounted inside the frame 63. The oil-retaining bearing 67 is mounted inside the shaft sleeve 65. The bottom of the shaft sleeve 65 is attached onto the circuit board 3 and the base substrate 4.

A groove 521 is defined around the surface of the shaft 52 and near the end portion of the shaft 52 proximate to the bottom of the space 51. No other groove is formed on the shaft 52., The shaft sleeve 65 has an internal flange 651. A stopper ring 66 is further provided under the shaft sleeve 65. When the shaft 52 penetrates through the shaft sleeve 65, the groove 521 on the shaft 52 engages with the stopper ring 66 while the internal flange 651 of the shaft sleeve 65 superimposes upon the stopper ring 66. Thereby, the stopper ring 66 is clamped between the internal flange 651 of the shaft sleeve 65 and the top of the oil-retaining bearing 67. Furthermore, the clearance between the stopper ring 66 and the groove 521 is so small that the stopper ring 66 seals the top of the oil-retaining bearing 67. Thereby, lubricant oil is stopped and retained in the oil-retaining bearing 67.

A wear resistant sheet 7 is further provided at the internal bottom of the shaft sleeve 65 that has an external bottom side in contact with the wear resistant sheet 7, as shown in FIG. 5. Chipping generated from friction of the rotating shaft 52 can be thereby prevented. At the internal bottom side of the shaft sleeve 65, the wear resistant sheet 7 is further mounted onto a magnetic device including a magnet 501 and a magnetically susceptible sheet 502. By means of the magnetic device, the shaft 52 is attracted, thereby allowing the blade module 5 to be mounted at a predefined location. Regardless of the placement orientation of the fan, the clearance between the metallic case 61 and the blade module 5 favorably is not significantly changed. The shaft sleeve 65 includes a portion 653 of larger diameter at its bottom and portion 652 of smaller diameter along the shaft sleeve 65. The shaft sleeve 65 can have a longitudinally uniform thickness. As shown in FIG. 5, near the junction between the portion 652 and the portion 653, the circuit board 3 is mounted on the portion 652 while the base substrate 4 is mounted on the portion 653.

The oil-retaining ring 66 can be made of Teflon, for example. The oil-retaining ring 66 has a smooth surface, so that lubricant oil flows downward once it has contacted with the .oil-retaining ring 66. The oil-retaining ring 66 therefore not only serves as oil stopper, but also buckles with the groove 521 of the shaft 52.

In FIG. 5, when the heat is generated from rotation of the fan, the lubricant oil flowing upward can be advantageously stopped by the oil-retaining ring 66 and is then redirected back along the surface of the oil-retaining bearing 67. The oil circulates in the oil-retaining bearing 67 without evaporation and great loss. Therefore, the lubrication is improved, and the deficiencies that usually occur in the prior art can be overcome.

Since the oil-retaining bearing 67 has a oil-retaining ring 66 which not only serves as oil stopper, but also buckles with the groove 521 of the shaft 52, the oil circulates in the oil-retaining bearing 67 without evaporation and great loss. The longevity of the fan is thus favorably increased. Furthermore, by means of the magnetic device, the shaft 52 is attracted to allow the blade module 5 to be mounted at a predetermined location. Regardless the placement orientation of the fan, the clearance between the metallic case 61 and the blade module 5 favorably is not significantly changed. The wear resistant sheet 7, the magnet 501 and the magnetically susceptible sheet 502 sequentially stacked at the bottom of the oil-retaining bearing 67 further enable to stop oil flowing. Therefore, both top and bottom of the oil-retaining bearing 67 can favorably prevent the oil in the oil-retaining bearing 67 from leaking out and/or evaporating.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. An electrical fan, comprising a blade module, a space being defined into the blade module and having a bottom where an end portion of a shaft is embedded; and a coil module respectively comprising an oil-retaining bearing, an oil retaining ring and a shaft sleeve, the shaft sleeve having an internal flange at a top thereof; the oil-retaining bearing being mounted inside the shaft sleeve, and the oil-retaining ring being clamped between the internal flange and the oil-retaining bearing after the shaft of the blade module penetrates through the shaft sleeve and the oil-retaining ring of the coil module.

2. The electrical fan as claimed in claim 1, wherein the internal flange of the shaft sleeve is further provided with a wear resistant sheet that contacts with an external bottom of the shaft of the blade module.

3. The electrical fan as claimed in claim 2, wherein a magnet device is further mounted at an bottom of the wear resistant sheet.

4. The electrical fan as claimed in claim 3, wherein the magnet device includes a magnet and a magnetically susceptible sheet.

5. The electrical fan as claimed in claim 1, wherein the oil-retaining ring is made of Teflon.

6. The fan as claimed in claim 1, wherein a groove is further defined around the shaft of the blade module near the bottom of the space.

* * * * *